United States Patent [19]

Cunningham

[11] 4,191,908

[45] Mar. 4, 1980

[54] CURRENT LIMITING SPARK GAP FOR ACHIEVING ARC ELONGATION, DIVISION AND COMPRESSION WITHOUT THE USE OF SUPPLEMENTARY MAGNETIC MEANS

[75] Inventor: Francis V. Cunningham, Western Springs, Ill.

[73] Assignee: Joslyn Mfg. and Supply Co., Chicago, Ill.

[21] Appl. No.: 967,906

[22] Filed: Dec. 11, 1978

[51] Int. Cl.[2] ..... H01J 17/00; H01J 21/00

[52] U.S. Cl. ..... 313/325; 361/134; 361/130; 361/137

[58] Field of Search ..... 313/325; 361/130, 134, 361/137

[56] References Cited

U.S. PATENT DOCUMENTS

| | | | |
|---|---|---|---|
| 2,890,389 | 6/1959 | Carpenter et al. | 361/134 X |
| 2,913,626 | 11/1959 | Bislin | 361/130 X |
| 2,917,662 | 12/1959 | Cunningham | 361/134 X |
| 3,151,273 | 9/1964 | Stetson et al. | 361/134 X |
| 3,242,376 | 3/1966 | Schultz | 361/137 X |
| 3,259,780 | 7/1966 | Stetson | 361/137 X |
| 3,361,923 | 1/1968 | Osterhout | 361/134 X |
| 3,443,149 | 5/1969 | Hazen | 313/326 X |
| 3,504,226 | 3/1970 | Stetson | 361/137 X |
| 3,968,393 | 7/1976 | Murano et al. | 313/325 |
| 4,052,639 | 10/1977 | Cunningham | 361/137 X |

*Primary Examiner*—Alfred E. Smith
*Assistant Examiner*—Charles F. Roberts
*Attorney, Agent, or Firm*—Mason, Kolehmainen, Rathburn & Wyss

[57] ABSTRACT

A current limiting spark gap for use in a high voltage valve type lightning or surge arrester includes a plurality of insulating gap plates assembled together in a vertical stack to define a generally horizontally extending arc elongation and cooling chamber between adjacent plates. Series gap electrodes are disposed along opposite sides of each plate and are double electrodes formed by a unitary piece of wire preformed to slide into position onto each plate. A gap spacer is provided in each arc chamber interfitting with the series gap electrodes and the insulating plates for accurately defining and enclosing the series gap and for maintaining the spark gap as an assembly. A new and improved spark initiator with two, resilient, ionizing arms is provided in each arc chamber for consistently achieving low impulse voltage sparkover. One or more auxiliary electrodes may be provided in each arc chamber to enhance power follow current limitation by dividing the arc into two or more arc portions and by rapidly elongating and moving the arc portions to the cooling wall portions of each arc chamber. The air gaps in each arc chamber formed between the gap electrodes converge to first air gaps of closest electrode spacing and then diverge along extended arc surfaces of the electrodes to and beyond where the spacing between extended arc surfaces is at least equal to three times the closest spacing.

34 Claims, 9 Drawing Figures

Fig. 1
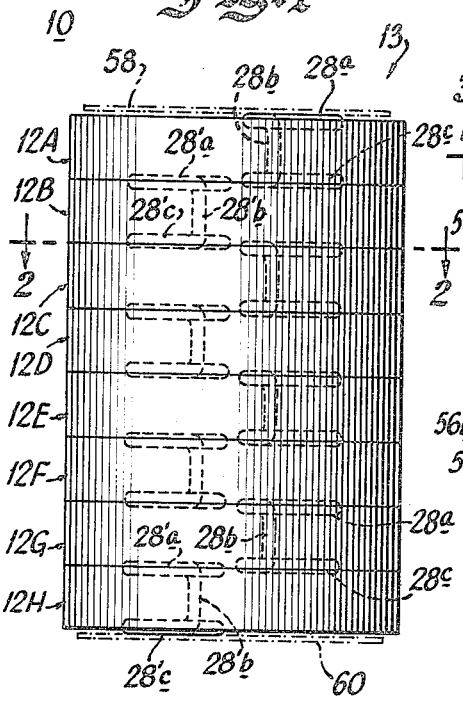
Fig. 2
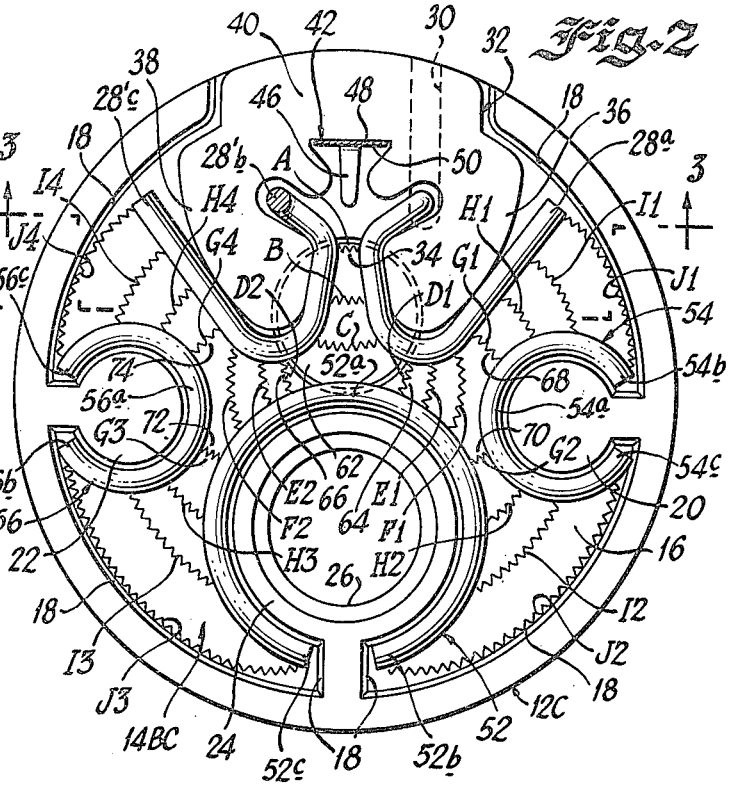
Fig. 3
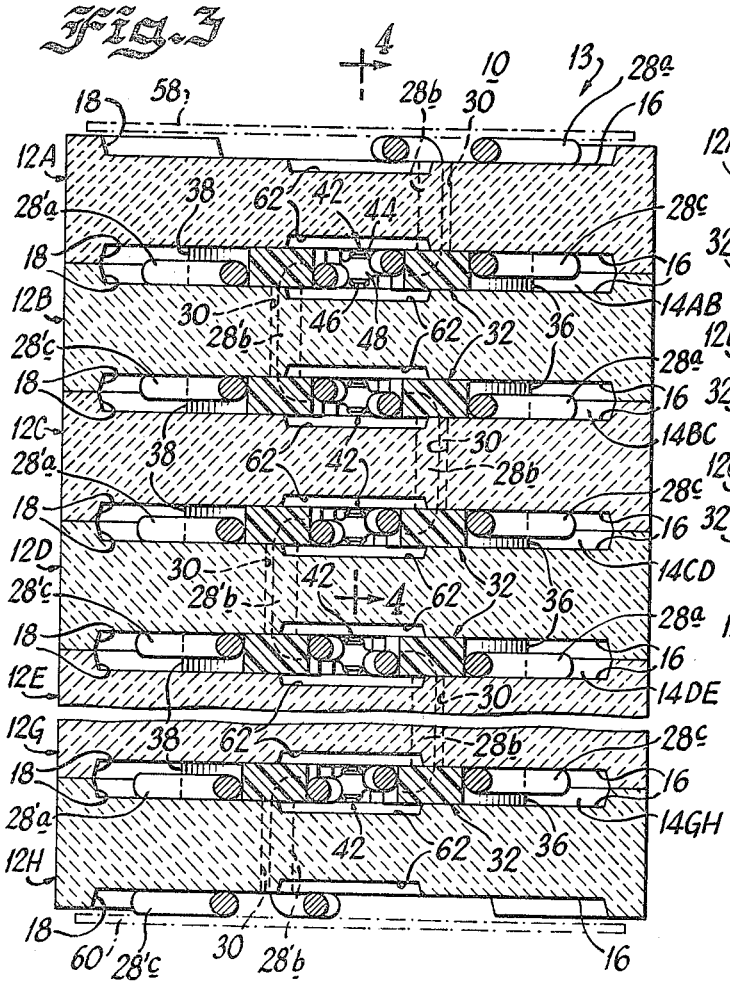
Fig. 4
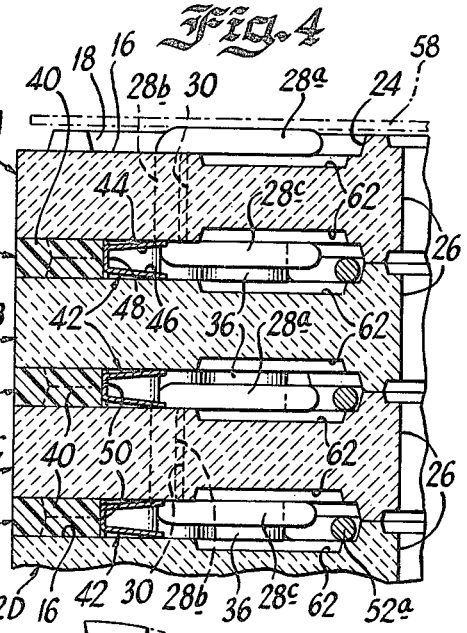
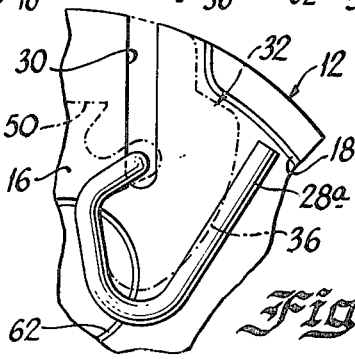
Fig. 5

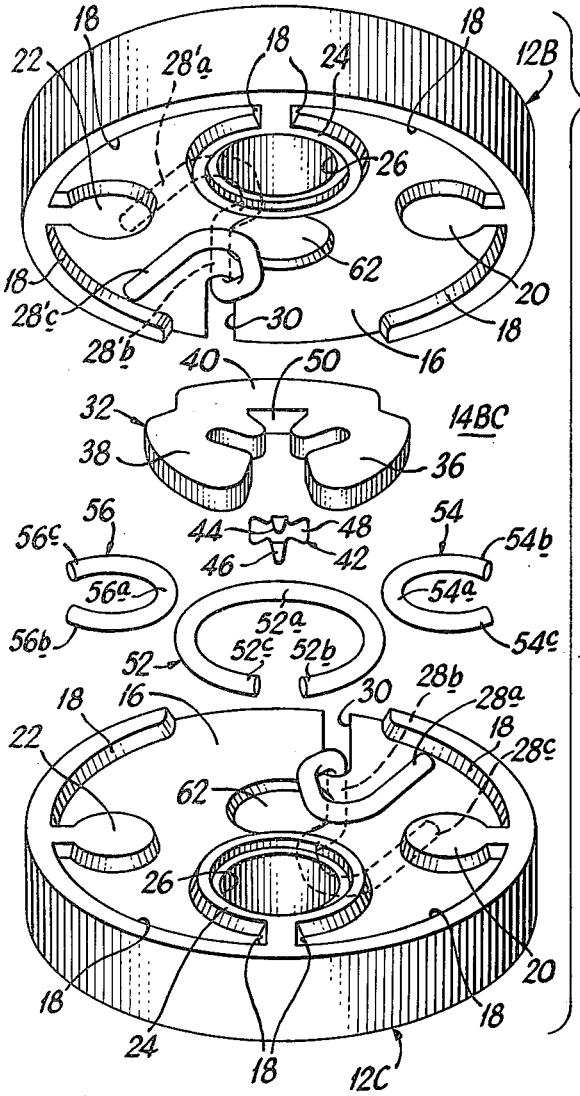
Fig. 8
Fig. 9
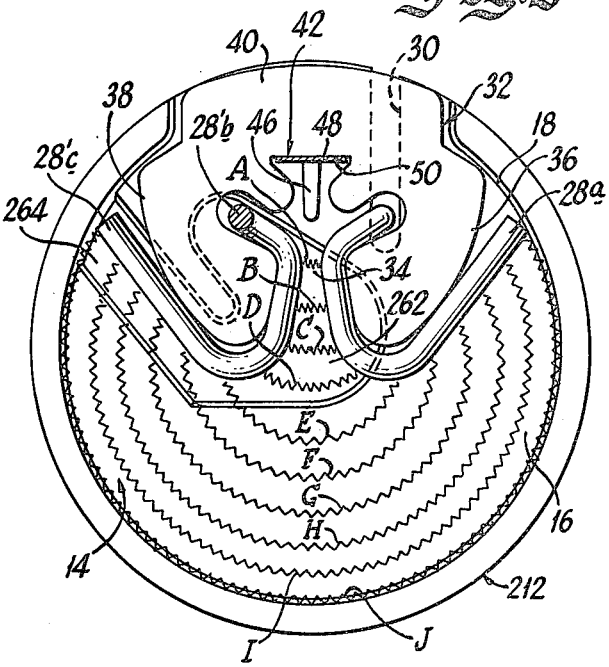
Fig. 7
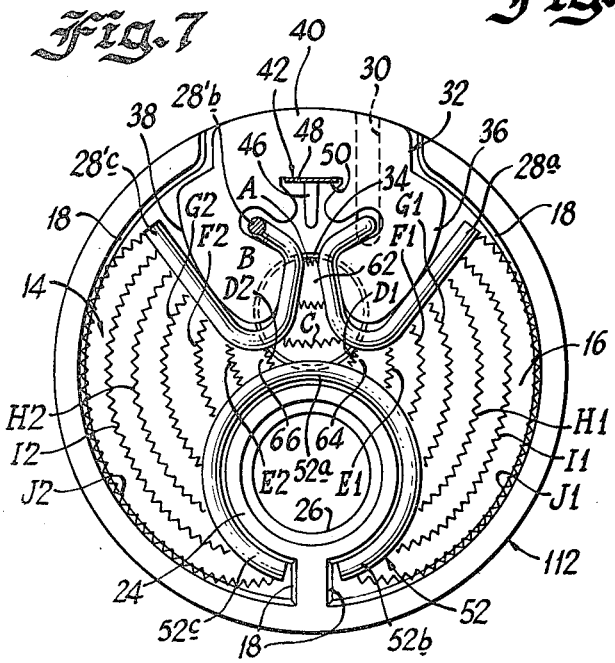
Fig. 9
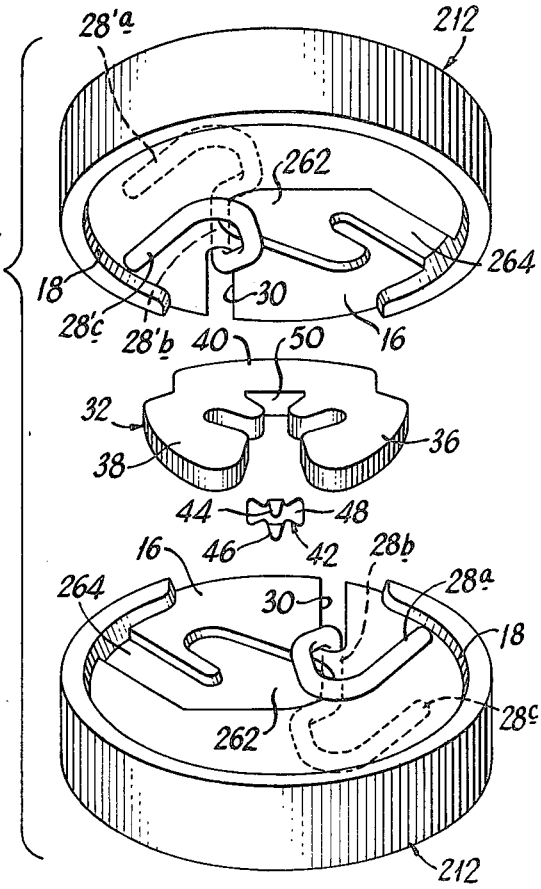

CURRENT LIMITING SPARK GAP FOR ACHIEVING ARC ELONGATION, DIVISION AND COMPRESSION WITHOUT THE USE OF SUPPLEMENTARY MAGNETIC MEANS

BACKGROUND OF THE INVENTION

A. Field of the Invention

The device of the present invention generally relates to a spark gap for a high voltage lightning or surge arrester, that is, a lightning or surge arrester for use on power systems of 2400 volts and higher, and, more particularly, to a current limiting spark gap for a high voltage valve type lightning or surge arrester.

B. Description of the Prior Art

Valve type surge arresters having a spark gap electrically connected in series with one or more blocks of non-linear resistance valve material and electrically connected between an electrical power line conductor and ground are well known in the prior art. Many prior art spark gaps utilize magnetic means, such as permanent magnets or electrical coils, for elongating electrical arcs to develop high arc voltages and to facilitate the interruption of power follow current.

Other prior art spark gaps utilize conductive electrode and arc chamber configurations to elongate power follow current arcs without the use of the above-mentioned supplementary magnetic means. Examples of the latter type of spark gaps are illustrated in U.S. Pat. Nos. 2,917,662; 3,242,376; 3,259,780; 3,504,226; and 4,052,639. Illustrative examples of other prior art electrode configurations are set forth in U.S. Pat. Nos. 2,890,389; 2,913,626; 3,361,923; and 3,968,393. Generally, the spark gaps illustrated in most of the above-identified patents suffer from one or more deficiencies. For example, a common deficiency is the necessarily complex and expensive configurations of the spark gaps. In addition, spark gaps in at least some of the above-identified patents do not develop sufficiently high arc voltages to significantly enhance power follow current limitation.

Thus, efforts are continuously being made in this particular art to develop new and improved conductive electrode and arc chamber configurations to increase arc voltages and thereby achieve improved power follow current limitation. Illustrative results of such efforts are set forth in applicant's prior U.S. Pat. No. 4,052,639. The spark gaps disclosed in this application represent further efforts by applicant to develop new and improved conductive electrode and arc chamber configurations for achieving improved power follow current limitation.

SUMMARY OF THE INVENTION

An object of the present invention is to provide a new and improved spark gap.

Another object of the present invention is to provide a new and improved current limiting spark gap for a valve type surge arrester.

Another object of the present invention is to provide a new and improved gap spacer for defining a series gap within a spark gap.

Another object of the present invention is to provide new and improved conductive electrode and arc chamber configurations for a current limiting spark gap.

Another object of the present invention is to provide a new and improved spark initiator for consistently achieving low impulse voltage sparkover in a spark gap.

Briefly, a new and improved spark gap for a valve type surge arrester is disclosed herein and includes a plurality of insulating gap plates assembled together in a vertical stack to define a generally horizontally extending arc elongation and cooling chamber between adjacent gap plates. Wall portions and surfaces are formed on each gap plate to define one half of an arc chamber. Series gap electrodes are disposed along opposite sides of each gap plate and, in the preferred embodiment, are double electrodes formed by a unitary piece of round or square wire preformed to slide into position on each gap plate through a slot formed in the gap plate. A gap spacer is provided in each arc chamber for accurately defining and enclosing the series gap and interfitting with the series gap electrodes and the gap plates to maintain the spark gap as an assembly. A new and improved spark initiator with two flexible ionizing arms is provided in each arc chamber for consistently achieving low impulse voltage sparkover. Finally, one or more auxiliary, C-shaped electrodes are provided in each arc chamber to enhance power follow current limitation by dividing the follow current arc into two or more arcs and by rapidly elongating and moving the arcs first along exposed, extended arc surfaces of the electrodes and then, compressing the arcs against the cooling wall portions of each arc chamber to thereby develop high arc voltages. The air gaps formed in each arc chamber between the series gap electrodes and the one or more auxiliary electrodes converge to first air gaps of closest electrode arc surface spacings and then diverge along extended arc surfaces of the electrodes to and beyond second air gaps where spacings between the extended arc surfaces of the electrodes are at least equal to three times the closest electrode arc surface spacings. In accordance with the preferred embodiment of the present invention, the cross-sectional areas of the electrodes are uniform along the extended arc surfaces to maximize magnetic flux density at arc termini moving along the arc surfaces. As used herein, arc surfaces of an electrode are those electrode surfaces that are disposed to receive electric current arc termini.

BRIEF DESCRIPTION OF THE DRAWING

The above and other objects and advantages and novel features of the present invention will become apparent from the following detailed description of the preferred embodiment of the present invention illustrated in the accompanying drawing wherein:

FIG. 1 is a side elevational view of a spark gap constructed in accordance with the principles of the present invention;

FIG. 2 is an enlarged, cross-sectional view of the spark gap of FIG. 1 taken along line 2—2 of FIG. 1;

FIG. 3 is an enlarged, cross-sectional view of the spark gap of FIG. 1 taken along line 3—3 of FIG. 2;

FIG. 4 is an enlarged, fragmentary, cross-sectional view of the spark gap of FIG. 1 taken along line 4—4 of FIG. 3;

FIG. 5 is an enlarged, fragmentary, cross-sectional view of a portion of the spark gap of FIG. 1 illustrating a series gap electrode prior to being interfitted with a gap spacer;

FIG. 6 is an enlarged, exploded, perspective view of a portion of the spark gap of FIG. 1;

FIG. 7 is an enlarged, cross-sectional view of a portion of an alternate embodiment of a spark gap constructed in accordance with the principles of the present invention;

FIG. 8 is an enlarged, cross-sectional view of a portion of a further alternate embodiment of a spark gap constructed in accordance with the principles of the present invention; and FIG. 9 is an enlarged, perspective view of a portion of a spark gap of the type depicted in FIG. 8.

DESCRIPTION OF THE PREFERRED EMBODIMENT

In accordance with important features of the present invention, a new and improved current limiting spark gap 10 (FIGS. 1 through 6) for use in a high voltage, i.e., 2400 volts or higher, lightning or surge arrester (not illustrated) for achieving arc elongation, division and compression by means of air gap, electrode and arc chamber configurations alone (i.e., without supplementary magnetic means, such as permanent magnets or electrical coils) includes a plurality of insulating gap plates 12 assembled together in a vertical stack 13 to define a generally horizontally extending arc elongation and cooling chamber 14 between adjacent, contiguous gap plates 12. In the specific embodiment disclosed in FIGS. 1 through 6, eight gap plates 12A through 12H are assembled together in the vertical stack 13 to form seven arc elongation and cooling chambers 14 (for example, the arc elongation and cooling chamber 14AB between the pair of gap plates 12A and 12B).

Insulating gap plates are well known in the prior art and may be manufactured from any one of many different formulations of ceramic or non-ceramic materials. For example, in accordance with the preferred embodiment, porous alumina may be used to form the porous, ceramic gap plates 12. For a more detailed discussion of gap plates, reference may be had to U.S. Pat. Nos. 3,151,273 and 3,443,149 and to the patents referred to therein.

In the preferred embodiment, each gap plate 12 includes generally horizontally extending surfaces 16 and generally vertically extending cooling wall portions 18 to define an arc chamber. In addition, each gap plate 12 includes a plurality of integrally formed upraised pedestal portions 20 and 22 and an integrally formed, upraised annular boss 24. The annular boss 24 surrounds an aperture 26 that extends through the gap plate 12 for accommodating a voltage grading resistor (not illustrated) disposed internally along the length of the spark gap 10. The voltage grading resistor can be internally accommodated within the spark gap 10 since gap plates 12 and the electrodes disposed thereon are configured and positioned to provide arc chambers and electrodes therein having similar horizontal configurations in vertical alignment throughout the vertical stack 13. This is achieved by configuring the major physical features of the upper surface 16 of the gap plate 12 to overlie and be substantially identical to similar physical features on an oppositely disposed lower surface 16 of the same gap plate 12. In addition, a conductive series gap electrode **28*a* (FIG. 2) is disposed along the upper surface 16 of a gap plate 12 to overlie a similar conductive series gap electrode 28*c* disposed along the lower surface 16 of the same gap plate 12. Similarly, a conductive series gap electrode 28'*a* is disposed along the upper surface 16 of an adjacent gap plate 12 to overlie a similar conductive series gap electrode 28'*c* disposed along the lower surface 16 of the same adjacent gap plate 12**.

In accordance with an important feature of the present invention, the electrodes **28*a* and 28*c* (and, similarly, 28'*a* and 28'*c*) are formed from a unitary piece of round or square wire as dual or double electrodes and are interconnected by an integrally formed connector portion 28*b* (and, similarly, 28'*b*). In the preferred embodiment, the double electrodes 28*a* and 28*c* are preformed to slide into position on each gap plate 12 as the connector portion 28*b* passes along an elongated slot 30 formed in each gap plate 12. While the electrodes 28*a*, 28'*a*, 28*c* and 28'*c* are shown in contact with the surfaces 16, in practice the electrodes may or may not contact the surfaces 16 depending upon manufacturing dimensional tolerances of the portion 28*b* and the plate 12**.

In accordance with a further important feature of the present invention, a new and improved gap spacer 32, that is formed separately and is physically distinct from the gap plate 12, is provided in each arc chamber 14 for accurately defining and enclosing a series gap 34 formed in each arc chamber 14 by the most closely spaced arc surface portions of the series gap electrodes **28*a* and 28'*c*. The gap spacer 32 is generally U-shaped and includes a first integrally formed series gap electrode contacting portion 36 and a second integrally formed series gap electrode contacting portion 38 that are fixedly spaced apart by and interconnected by an integrally formed bridging portion 40. As such, the spacer 32 is an insulating spacer when molded of an insulating material, such as non-ceramic, nylon plastic resin. The spacer 32** may also be used as a spark gap voltage divider when made of a conductive or semiconductive material, or when made of material having a high specific inductive capacitance, all as will be readily understood by those skilled in the art.

As illustrated in FIG. 2, the first portion 36 physically contacts and interfits with the series gap electrode **28*a* in an interlocking, press or snap fit manner. Similarly, the second portion 38 physically contacts and interfits with the series gap electrode 28'*c* in an interlocking, press or snap fit manner to thereby accurately define and maintain the electrode spacing of the series gap 34. As illustrated in FIG. 5, the series gap electrodes 28*a* and 28'*c* (and, similarly, the electrodes 28'*a* and 28*c*) are generally U-shaped portions that are formed to be initially undersized with respect to the lateral dimensions of the contacting portions 36 and 38 of the gap spacer 32 to thereby enable the gap spacer 32** to securely interfit with the electrodes in an interlocking, press or snap fit manner.

In addition, the bridging portion 40 interfits on the plate 12 where a peripherally extending section of the generally vertically extending cooling wall portions 18 of each gap plate 12 is removed to allow the electrodes **28*a* and 28*c* to slide onto the plate surfaces 16. When so positioned, the gap spacer 32 takes the place of the removed peripheral section, encloses the series gap arc chamber, and cooperates with the series gap electrodes 28*a* and 28'*c* and the gap plates 12 to maintain the spark gap 10 as an aligned and interlocked assembly (except for a pair of upper and lower spark gap conductive metallic end plates 58 and 60**, discussed more fully hereinafter) during its handling and subsequent installation into a high voltage lightning or surge arrester.

In accordance with a further important feature of the present invention, a new and improved spark initiator 42, formed in a preferred embodiment from 0.006 inch thick brass, with integrally formed, upper and lower, flexible, resilient ionizing arms 44 and 46, respectively, is provided in each arc chamber 12 for consistently achieving low impulse voltage sparkover in the presence of a voltage surge or impulse across the series gap 34. The dual ionizing arms 44 and 46 of the spark initiator 42 are interconnected by an integrally formed, laterally extending, generally "bow-tie" shaped portion 48 that is designed to interfit with and to be held in place by a slotted portion 50 of the gap spacer 32 to retain the spark initiator 42 in close proximity to the series gap 34. The ionizing arms 44 and 46 are resiliently compressed into contact with the facing, upper and lower surfaces 16 of adjacent gap plates 12.

In accordance with a further important feature of the present invention, the spark gap 10 includes in each arc chamber 14 a first, auxiliary, generally C-shaped conductive electrode 52 and second and third, auxiliary, generally C-shaped conductive electrodes 54 and 56, respectively disposed about the annular boss 24 and the pedestal portions 20 and 22, for dividing and, subsequently subdividing the power follow current arc moving from the series gap 34, thereby to enhance power follow current limitation. Preferably, all of the electrodes 28, 52, 54 and 56 are formed from round or square wire stock to have generally uniform cross-sections along their entire lengths. In a specific embodiment, the electrodes 28, 52, 54 and 56 are formed from 0.0808 inch diameter round copper wire. The electrodes 52, 54 and 56, having centrally disposed bight portions **52*a*, 54*a* and 56*a* that interconnect generally converging end portions 52*b* and *c*, 54*b* and *c*, and 56*b* and *c*, are designed to initially receive an arc in the region of the bight portions 52*a*, 54*a* and 56*a* and then to move the divided and subdivided arc portions and their related arc termini into the air gaps 64, 66, 68, 70, 72 and 74, then along the converging end portions 52*b* and *c*, 54*b* and *c*, and 56*b* and *c* and, ultimately, to compress the arc portions against the cooling wall portions 18 of the arc chamber 14**. This arc movement occurs as a result of magnetic flux concentrated between the current flowing in the electrodes and the current flowing in the arc portion.

Generally, the operation of the new and improved current limiting spark gap 10 is as follows. Upon the occurrence of a voltage surge passed from a power line to the spark gap 10 through a pair of oppositely disposed, upper and lower spark gap conductive metallic end plates 58 and 60 (FIGS. 1 and 3) respectively disposed adjacent to and in contact with electrodes **28*a* and 28'*c* at the upper and lower extremities of the spark gap 10, voltage stress concentration at the ends of the ionizer arms 46 adjacent series gap 34 ionizes the air space in the region of the series gap 34 to cause the series gap 34 to arc over at a relatively low voltage. An illustrative initial arc "A" occurring across the series gap 34 is depicted in FIG. 2. Preferably, a depression or recess 62 is provided in each surface 16 of each gap plate 12 to displace the surface 16 from close contact with the arc and the hot gases formed by the sparkover of the series gap 34. The expanding hot gases, enclosed within the generally U-shaped spacer 32, must now move toward the open end of the spacer, aiding initial movement of the arc in the same direction. Also, since the bridging portion 40 takes the place of at least a major portion of the removed section of the peripheral wall portions 18**, the hot gases are substantially blocked from escape to the exterior of the gap structure where they might otherwise cause an external electrical flashover to damage the structure.

Due to the high magnetic flux density in the region of the initially converging portions of the series gap electrodes **28*a* and 28'*c*, a relatively high resultant magnetic force rapidly moves the initial arc "A" outwardly along the diverging portions of the series gap electrodes 28*a* and 28'*c* and into the more remotely disposed portions of the arc elongation and cooling chamber 14. Illustrative successive locations of the moving power follow current arc are designated "B" and "C" in FIG. 2**.

The configurations of the electrodes **28*a* and 28'*c* are designed to concentrate magnetic flux behind the arc to rapidly move the initial undivided power follow current arc away from the series gap 34 in the direction of the bight portion 52*a* of the electrode 52. Here the arc is divided into two arc portions moving between the arc surfaces of electrodes 28*a* and 52 and between arc surfaces of the electrodes 28'*c* and 52 and to their most closely spaced portions or air gaps 64 and 66, respectively, that are located generally at the transition points between the respectively converging portions of the electrode pairs 28*a*, 52 and 28'*c*, 52 and the more remotely disposed, respectively diverging portions of the same electrode pairs. Illustrative, divided follow current arc portions "D1" and "D2" across the gaps 64 and 66 are depicted in FIG. 2**.

Due to the relatively high magnetic flux density behind or interiorly of the divided arc portions "D1" and "D2", a high resultant magnetic force rapidly moves the divided arc portions away from the gaps 64 and 66 towards the peripherally disposed cooling wall portions 18, thereby further elongating the power follow current arc in the chamber 14. Illustrative successive locations of the moving, divided arc portions are designated "E1", "E2" and "F1", "F2" in FIG. 2.

As the elongated divided arc portions move outwardly along the arc surfaces of electrodes **28*a*, 28'*c* and 52, they eventually encounter bight portions 54*a* and 56*a* and electrode spacings or air gaps 68, 70, 72 and 74 formed between the most closely spaced portions of the electrode pairs 28*a*, 54; 54, 52; 52, 56; and 56, 28'*c*. The air gaps 68, 70, 72 and 74 generally occur at the transitions between the respectively converging portions of those electrode pairs and their more remotely disposed, respectively diverging portions. The divided arc portions normally subdivide at the bight portions 54*a* and 56*a*; and the subdivided arc portions move to and pass the air gaps 68, 70, 72 and 74. Illustrative, subdivided arc portions "G1", "G2", "G3" and "G4" appear at the air gaps 68, 70, 72 and 74**.

Due to the relatively high resultant magnetic force present and acting thereon, the subdivided arc portions are rapidly moved outwardly towards the peripherally disposed cooling wall portions 18 in the arc chamber 14 along the respectively diverging portions of the electrode pairs discussed above. Illustrative successive locations of the moving, subdivided arc portions are "H1" through "H4", "I1" through "I4" and "J1" through "J4", as depicted in FIG. 2. Illustrative, subdivided arc portions "J1" through "J4" are shown compressed by the high resultant magnetic force acting thereon against the cooling wall portions 18 in the arc chamber 14. The large power follow current arc elongation across the subdivided arc portions "J1" through "J4" and the arc compression against the cooling wall portions 18 result in higher arc voltages and, thus, smaller power follow current magnitudes than possible with the above-mentioned prior art electrode configurations, specifically those disclosed in U.S. Pat. No. 3,242,376. The converging and diverging configurations of portions of the electrodes 28, 52, 54 and 56 and their dispositions within the chamber 14 (FIG. 2) enable the rapid movement of the power follow current arc and arc portions away from the series gap 34 and the air gaps 64, 66, 68, 70, 72, and 74 and to the cooling wall portions 18 to enable the rapid achievement of high arc voltages. As illustrated in FIG. 2, the electrodes 28*a*, 28′*c*, 52, 54 and 56 have respectively converging electrode portions that converge to first air gaps 34, 64, 66, 68, 70, 72 and 74 of closest electrode or electrode arc surface spacing and then diverge along the extended electrode arc surfaces to and beyond second air gaps where the electrode and arc surface spacing along a straight line is at least equal to three times the closest electrode arc surface spacing. Preferably, the cross-sectional area of the electrodes 28*a*, 28′*c*, 52, 54 and 56 is uniform between the first air gaps and the second air gaps and the widths of the electrodes 28*a*, 28′*c*, 52, 54 and 56 between the first air gaps and the second air gaps are less than the lengths or distances along the electrodes between the first air gaps and the second air gaps. Thus, relatively high magnetic flux densities are generated at arc termini and behind the arc to cause the rapid movement of the power follow current arc and arc portions in the arc chamber 14 from the first air gaps to and beyond the second air gaps where the electrode spacings, at least equal to three times that of the closest electrode spacings at the first air gaps, rapidly develop high arc voltages within each chamber 14 to enhance power follow current limitation in the spark gap 10. This is achieved, in accordance with the preferred embodiment, without the use of supplementary magnetic means, such as permanent magnets or electrical coils.

Finally, it should be noted that the remote end portions of the electrodes 28*a* and 28′*c* closest to the cooling wall portions 18 and the converging end portions 52*b* and *c*, 54*b* and *c* and 56*b* and *c* function not only to rapidly move, elongate and compress a power follow current arc and arc portions against the cooling wall portions 18 of the arc chamber 14 but also position and maintain the position of the respective electrodes 28*a*, 28′*c*, 52, 54 and 56 within the arc chamber 14. This is achieved by the snap fit interfitting relationship between the initially undersized series gap electrodes 28*a* and 28′*c* and the gap spacer 32 (FIGS. 2, 3 and 5) and by the generally C-shaped configurations of the auxiliary electrodes 52, 54 and 56 that are disposed, respectively, about the annular boss 24 and the pedestal portions 20 and 22 (FIGS. 4 and 6). In addition, in order to increase magnetic flux density at arc termini, to thereby increase the magnetic force applied to move the arcs within the arc chamber 14, the diameter or width of each electrode 28*a*, 28′*c*, 52, 54 and 56 is less than twice the spacing of each gap 34, 64, 66, 68, 70, 72 or 74 with which each such electrode is associated.

In accordance with an important feature of the present invention, an alternate embodiment of the spark gap 10 of FIG. 1 utilizing less costly and complex electrode and gap plate configurations (FIG. 7) provides for the rapid movement, elongation, division and compression of power follow current arcs and divided arc portions against the cooling wall portions 18 in the arc chambers 14.

The alternate embodiment of applicant's inventive spark gap 10 (FIG. 1) illustrated in FIG. 7 utilizes essentially the same components as those depicted in FIGS. 2–6 except that the auxiliary electrodes 54 and 56 and their associated pedestal portions 20 and 22 are omitted from the modified gap plates 112. Thus, after a power follow current arc initially appearing across the series gap 34 divides into two arc portions at the bight portion 52*a* and subsequently appears as illustrative arc portions "D1" and "D2" at the air gaps 64 and 66 of closest electrode spacings, the divided arc portions are rapidly moved outwardly towards the periphery of the arc chamber 14 to and beyond air gaps where the spacings between the arc surfaces of the electrode pairs 28*a*, 52 and 28′*c*, 52 are at least equal to three times the closest electrode or electrode arc surface spacings at the air gaps 64 and 66. Successive, illustrative locations of the moving divided arc portions are depicted in FIG. 7 as "E1", "E2"; "F1", "F2"; "G1", "G2"; "H1", "H2"; "I1", "I2"; and "J1", "J2". As in the embodiment of FIG. 2, the cross-sectional areas of the electrodes 28*a*, 28′*c* and 52 depicted in FIG. 7 are uniform between the first air gaps 64 and 66 and the second air gaps referred to above; and the widths of the electrodes 28*a*, 28′*c* and 52 are less than the lengths of the extended arc surfaces along the electrodes 28*a*, 28′*c* and 52 between the first and second air gaps.

A further alternate embodiment (FIGS. 8 and 9) of the inventive spark gap 10 (FIG. 1) utilizes a plurality of insulating gap plates 212 assembled together in a vertical stack 13 (FIG. 1) to form an effective, but relatively inexpensive and simple, current limiting spark gap 10. The insulating gap plates 212 may be manufactured from any one of many different formulations of materials, for example, from alumina, steatite, or plastic resin, to form porous or non-porous gap plates 212. The spark gap 10 represented in FIGS. 8 and 9 differs from that represented in FIGS. 2 through 6 in that no auxiliary electrodes, such as the electrodes 52, 54 and 56, are provided in the arc elongation and cooling chamber 14. In addition, the associated pedestal portions 20 and 22 and the annular boss 24 (FIG. 2) are omitted from the generally horizontally extending surfaces 16 of the gap plates 212. However, the series gap electrodes 28 and 28′, the gap spacer 32, and the spark initiator 42 are provided in each arc chamber 14 and cooperatively function in essentially the same manner as described hereinabove with respect to the embodiment of FIG. 2. Thus, the series gap electrodes 28*a* and 28′*c* have initial converging portions that converge to a series gap 34 of closest electrode spacing and then diverge along their terminal portions to encourage the rapid movement and elongation of a power follow current arc into the remotely disposed portions of the arc chamber 14. Illustrative locations of the moving power follow current arc are "B" through "J" as depicted in FIG. 8. Due to similar configurations of the series gaps, an arc will move from positions A to positions C equally as rapidly in each of the gap structures depicted in FIG. 2, FIG. 7 and FIG. 8. In FIG. 8, the movement will be progressively slowed as the arc progressively lengthens to successive positions D, E, etc. Actually, there will be a tendency for the arc to fail to move beyond position E or F, since the magnetic force moving the arc becomes weaker as the distance of the arc from the current flowing in the electrodes is increased. This tendency is effectively overcome by the addition of auxiliary electrode 52, FIG. 7. Here the arc will rapidly subdivide and continue rapid movement at least to F1, F2, or G1, G2, with a tendency not to move beyond H1, H2, even though the arc will sometimes move to the positions J1, J2 against the cooling walls 18. Again, this tendency is overcome by the addition of electrodes 54, 56 of FIG. 2. Here the arcs will continue rapid movement right up to compression against the cooling walls 18, arc position J1–J4, due to high magnetic forces as a result of the proximity of current in the arc to current flowing in the electrodes. Thus, the addition of an auxiliary electrode such as electrode 52 increases both the rate of rise of arc voltage as well as the arc voltage magnitude. The addition of auxiliary electrodes such as electrodes 54 and 56 produces an even further increase in rate-of-rise and magnitude of arc voltage, resulting in greatly improved current limiting capability, which in turn allows for significant reductions in surge arrester discharge voltage.

In accordance with an important feature of the alternate embodiment of FIG. 8, a depression or recess 262 is formed in the generally horizontally extending surfaces 16 of the gap plates 212. The recess 262 not only performs the same function set forth above with respect to the depression or recess 62 in the surface 16 of the gap plate 12 (FIG. 2), but also includes a radially extending relief portion 264 (FIG. 8) that extends generally outwardly from the centrally disposed portion of the recess 262 and follows and underlies the elongated terminal portion of the series gap electrode 28'c physically secured to an adjacent gap plate 212 that forms the chamber 14 with the gap plate 212 depicted in FIG. 8. The relief portion 264 provides a space or vertical separation between the series gap electrode 28'c and the surface 16 of the gap plate 212 to increase the corona inception voltage within the chamber 14 and thereby reduce radio frequency interference from the spark gap 10.

Obviously, many modifications and variations of the present invention are possible in light of the above teachings. Thus, it is to be understood that, within the scope of the appended claims, the invention may be practiced otherwise than as specifically described hereinabove. In one or more of the following claims, the inventive spark gap 10 disclosed herein is defined as including a plurality of insulating gap plates for defining an arc chamber and a plurality of electrodes disposed in the arc chamber wherein the arc chamber and the electrodes provide the sole means for the lengthening and compression of follow current arcs. This recitation is intended to specifically exclude from the scope of the claimed invention the use of supplementary magnetic means, such as permanent magnets and electrical coils, to lengthen and compress follow current arcs within an arc chamber. In addition, in one or more of the following claims, the inventive spark gap is defined as a spark gap for a high voltage surge arrester. The expression "high voltage" surge arrester means a surge arrester for use on power systems of 2400 volts and higher.

What is claimed and desired to be secured by Letters Patent of the United States is:

1. A spark gap for a high voltage surge arrester comprising a plurality of at least two generally horizontally disposed, contiguous insulating gap plates configured to form a generally horizonally extending arc elongation and cooling chamber therebetween and means for forming a series gap within said arc chamber, said series gap forming means comprising first and second, preformed, conductive series gap electrodes and spacing means interfitting with said series gap electrodes for spacing said series gap electrodes apart to define said series gap, said spacing means comprising a gap spacer that is physically separate from, but removably engageable with at least one of said gap plates, said gap spacer including a first, integrally formed extending portion interfitting with said first series gap electrode, a second, integrally formed extending portion interfitting with said second series gap electrode and a third integrally formed bridging portion disposed between and fixedly spacing apart said first and second integrally formed portions of said gap spacer.

2. A spark gap as recited in claim 1 wherein said gap spacer is formed of a different material than the material forming said gap plates.

3. A spark gap as recited in claim 1 wherein said first and second series gap electrodes are preformed to interfit in a snap fit manner with said first and second portions of said gap spacer to thereby securely retain said first and second series gap electrodes in contact with said gap spacer.

4. A spark gap structure as recited in claim 3 wherein said first and second series gap electrodes comprise first and second series gap wire electrodes.

5. A spark gap as recited in claim 1 wherein said gap spacer has a generally U-shaped configuration.

6. A spark gap as recited in claim 3 wherein at least one of said series gap electrodes comprises one electrode of a pair of wire electrodes preformed as integral portions of a unitary length of wire and configured to be respectively disposed above and below generally horizontally extending surfaces of the same one of said gap plates, said pair of wire electrodes being interconnected by a third integrally formed portion of the same length of wire.

7. A spark gap as recited in claim 1 further comprising air ionizing means for initiating the sparkover of said series gap, said gap spacer including integrally formed means for positioning within said arc chamber said air ionizing means in proximity to said series gap.

8. A spark gap as recited in claim 7 wherein said air ionizing means comprises a unitary metallic component having at least first and second integrally formed, vertically spaced apart, elongated ionizing arms extending outwardly from a third, integrally formed, interconnecting portion of said unitary metallic component, the remote longitudinal ends of said ionizing arms being disposed in proximity to said series gap and closer to said series gap than said third portion of said unitary metallic component.

9. A spark gap as recited in claim 8 wherein said first and second ionizing arms are preformed to contact and be resiliently compressed by contact with the facing, generally horizontally extending lower and upper surfaces, respectively, of said gap plates.

10. A spark gap as recited in claim 1 wherein said gap plates are ceramic gap plates and wherein said gap spacer is a non-ceramic gap spacer.

11. A spark gap as recited in claim 1 wherein said gap spacer comprises a voltage divider.

12. A spark gap as recited in claim 1 wherein said ceramic gap plates are porous, ceramic gap plates.

13. A spark gap as recited in claim 1 further comprising a third conductive electrode disposed in said arc chamber and forming a second air gap between the most closely spaced portions of said first and third electrodes and a third air gap between the most clearly spaced portions of said second and third electrodes.

14. A spark gap as recited in claim 13 wherein said first and third electrodes have integral portions that respectively converge to form said second air gap and then respectively diverge to and beyond a fourth air gap therebetween, the electrode separation at said fourth air gap being equal to three times the electrode separation at said second air gap, said second and third electrodes having integral portions that respectively converge to form said third gap and then respectively diverge to and beyond a fifth air gap therebetween, the electrode separation at said fifth air gap being equal to three times the electrode separation at said third air gap.

15. A spark gap as recited in claim 1 further comprising third, fourth and fifth conductive electrodes disposed in said arc chamber, a second air gap being formed between the most closely spaced portions of said first and third electrodes, a third air gap being formed between the most closely spaced portions of said second and third electrodes, a fourth air gap being formed between the most closely spaced portions of said first and fourth electrodes, a fifth air gap being formed between the most closely spaced portions of said third and fourth electrodes, a sixth air gap being formed between the most closely spaced portions of said third and fifth electrodes, and a seventh air gap being formed between the most closely spaced portions of said second and fifth electrodes.

16. A spark gap for a high voltage surge arrester comprising at least two contiguous insulating gap plates configured to form an arc elongation and cooling chamber therebetween and means for forming a series gap within said arc chamber, said series gap forming means comprising first and second conductive series gap electrodes spaced apart to form said series gap between the most closely spaced portions thereof and spacing means for spacing said series gap electrodes apart to define said series gap, said spacing means comprising a unitary gap spacer that is physically separate from, but removably engageable with at least one of said gap plates.

17. A spark gap as recited in claim 16 wherein said gap spacer includes a first, integrally formed, extending portion interfitting with said first series gap electrode and a second, integrally formed, extending portion interfitting with said second series gap electrode to thereby define and maintain said series gap between said first and second series gap electrodes.

18. A spark gap as recited in claim 17 wherein said gap spacer further includes a third, integrally formed, bridging portion disposed between and fixedly spacing apart said first and second, integrally formed portions of said gap spacer.

19. A spark gap as recited in claim 17 wherein said first and second series gap electrodes are preformed to interfit in a snap fit manner with said first and second portions of said gap spacer to thereby securely retain said first and second series gap electrodes in contact with said gap spacer.

20. A spark gap as recited in claim 17 wherein said first and second series gap electrodes are first and second series gap wire electrodes.

21. A spark gap for a high voltage surge arrester comprising a plurality of at least two generally horizontally disposed, contiguous, insulating gap plates configured to form a generally horizontally extending arc elongation and cooling chamber therebetween, means for forming a series gap within said arc chamber and air ionizing means disposed within said arc chamber for initiating the sparkover of said series gap, said air ionizing means comprising a unitary metallic component having at least first and second, integrally formed, vertically spaced spart, elongated, ionizing arms extending outwardly from a third, integrally formed, interconnecting portion of said unitary metallic component, the free longitudinal ends of said ionizing arms being disposed in proximity to said series gap and closer to said series gap than said third portion of said unitary metallic component, said first and second ionizing arms being preformed to contact and be spring loaded or resiliently compressed by contact with the facing, generally horizontally extending lower and upper surfaces, respectively, of said two, contiguous gap plates.

22. A current limiting spark gap for a high voltage surge arrester comprising insulating means for forming an arc elongation and cooling chamber, means for forming a series gap within said arc chamber, said series gap forming means comprising first and second series gap electrodes spaced apart to form said series gap between the most closely spaced portions thereof and a third electrode disposed in said arc chamber and forming a second air gap between the most closely spaced portions of said first and third electrodes and a third air gap between the most closely spaced portions of said second and third electrodes, said first and third electrodes each having portions that respectively converge to form said second air gap and then respectively diverge to and beyond a fourth air gap therebetween, the electrode separation at said fourth air gap being equal to three times the electrode separation at said second air gap, said second and third electrodes having integral portions that respectively converge to form said third air gap and then respectively diverge to and beyond a fifth air gap therebetween, the electrode separation at said fifth air gap being equal to three times the electrode separation at said third air gap, said first and third electrodes respectively having uniform cross-sectional areas between said second air gap and said fourth air gap and said second and third electrodes respectively having uniform cross-sectional areas between said third air gap and said fifth air gap, the widths of said first and third electrodes at said uniform cross-sectional areas being respectively less than the lengths along said first and third electrodes between said second air gap and said fourth air gap and the widths of said second and third electrodes at said uniform cross-sectional areas being respectively less than the lengths along said second and third electrodes between said third air gap and said fifth air gap.

23. A current limiting spark gap as recited in claim 22 wherein said widths of said first and third electrodes are each less than twice the electrode separation at said second air gap and wherein said widths of said second and third electrodes are each less than twice the electrode separation at said third air gap.

24. A current limiting spark gap as recited in claim 22 wherein said arc chamber and said first, second and third electrodes provide the sole means for the lengthening and compression of follow current arcs within said arc chamber.

25. A current limiting spark gap for a high voltage surge arrester comprising insulating means for forming an arc elongation and cooling chamber, means for forming a series gap within said arc chamber, said series gap forming means comprising first and second, conductive, series gap electrodes spaced apart to form said series gap between the most closely spaced portions thereof, and third, fourth and fifth conductive electrodes disposed in said arc chamber, a second air gap being formed between the most closely spaced portions of said first and third electrodes, a third air gap being formed between the most closely spaced portions of said second and third electrodes, a fourth air gap being formed between the most closely spaced portions of said first and fourth electrodes, a fifth air gap being formed between the most closely spaced portions of said third and fourth electrodes, a sixth air gap being formed between the most closely spaced portions of said third and fifth electrodes, and a seventh air gap being formed between the most closely spaced portions of said second and fifth electrodes, said first and third electrodes having integral portions that respectively converge to form said second air gap and then respectively diverge thereafter, said second and third electrodes having integral portions that respectively converge to form said third air gap and then respectively diverge thereafter, said first and fourth electrodes having integral portions that respectively converge to form said fourth air gap and then respectively diverge to and beyond an eighth air gap therebetween, the electrode separation at said eighth air gap being equal to three times the electrode separation at said fourth air gap, said third and fourth electrodes having integral portions that respectively converge to form said fifth air gap and then respectively diverge to and beyond a ninth air gap therebetween, the electrode separation at said ninth air gap being equal to three times the electrode separation at said fifth air gap, said third and fifth electrodes having integral portions that respectively converge to form said sixth air gap and then respectively diverge to and beyond a tenth air gap therebetween, the electrode separation at said tenth air gap being equal to three times the electrode separation at said sixth air gap, said second and fifth electrodes having integral portions that respectively converge to form said seventh air gap and then respectively diverge to and beyond an eleventh air gap therebetween, the electrode separation at said eleventh air gap being equal to three times the electrode separation at said seventh air gap, said first and fourth electrodes respectively having uniform cross-sectional areas between said fourth air gap and said eighth air gap, said third and fourth electrodes respectively having uniform cross-sectional areas between said fifth air gap and said ninth air gap, said third and fifth electrodes respectively having uniform cross-sectional areas between said sixth air gap and said tenth air gap and said second and fifth electrodes respectively having uniform cross-sectional areas between said seventh air gap and said eleventh air gap, the widths of said first and fourth electrodes at said uniform cross-sectional areas being respectively less than the lengths along said first and fourth electrodes between said fourth air gap and said eighth air gap, the widths of said third and fourth electrodes at said uniform cross-sectional areas being respectively less than the lengths along said third and fourth electrodes between said fifth air gap and said ninth air gap, the widths of said third and fifth electrodes at said uniform cross-sectional areas being respectively less than the lengths along said third and fifth electrodes between said sixth air gap and said tenth air gap and the widths of said second and fifth electrodes at said uniform cross-sectional areas being respectively less than the lengths along said second and fifth electrodes between said seventh air gap and said eleventh air gap.

26. A spark gap as recited in claim 25 wherein said widths of said first and fourth electrodes are each less than twice the electrode separation at said fourth air gap, wherein said widths of said third and fourth electrodes are each less than twice the electrode separation at said fifth air gap, wherein said widths of said third and fifth electrodes are each less than twice the electrode separation at said sixth air gap and wherein said widths of said second and fifth electrodes are each less than twice the electrode separation at said seventh air gap.

27. A spark gap as recited in claim 25 wherein each of said first, second, third, fourth and fifth electrodes is a wire electrode.

28. A spark gap as recited in claim 27 wherein said third, fourth and fifth electrodes are all C-shaped wire electrodes.

29. A spark gap as recited in claim 25 wherein said arc chamber and said first, second, third, fourth and fifth electrodes provide the sole means for the lengthening and compression of follow current arcs within said arc chamber.

30. A current limiting spark gap for a high voltage surge arrester comprising insulating means for forming an arc elongation and cooling chamber and conductive means disposed within said arc chamber for forming a first series gap within said arc chamber and at least a second gap and a third gap within said arc chamber, said conductive means comprising a plurality of conductive electrodes, said second gap being formed between the most closely spaced portions of two of said plurality of conductive electrodes that have integral portions that respectively converge to form said second gap and then respectively diverge to and beyond a fourth gap therebetween, the electrode separation at said fourth gap being equal to three times the electrode separation at said second gap, said third gap being formed between the most closely spaced portions of two of said plurality of conductive electrodes that have integral portions that respectively converge to form said third gap and then respectively diverge to and beyond a fifth gap therebetween, the electrode separation at said fifth gap being equal to three times the electrode separation at said third gap, the conductive electrodes forming said second gap respectively having uniform cross-sectional areas between said second gap and said fourth gap and the conductive electrodes forming said third gap respectively having uniform cross-sectional areas between said third gap and said fifth gap, the widths at said uniform cross-sectional areas of said conductive electrodes forming said second gap being respectively less than the lengths along said conductive electrodes between said second gap and said fourth gap and the widths at said uniform cross-sectional areas of said conductive electrodes forming said third gap being respectively less than the lengths along said conductive electrodes between said third gap and said fifth gap.

31. A current limiting spark gap as recited in claim 30 wherein said widths of said conductive electrodes forming said second gap are each less than twice the electrode separation at said second gap and wherein the widths of said conductive electrodes forming said third gap are each less than twice the electrode separation at said third gap.

32. A current limiting spark gap as recited in claim 30 wherein said plurality of conductive electrodes are all wire electrodes.

33. A current limiting spark gap as recited in claim 30 wherein said arc chamber and said plurality of conductive electrodes provide the sole means for the lengthening and compression of follow current arcs within said arc chamber.

34. A spark gap for a high voltage surge arrester comprising contiguous, vertically stacked insulating gap plates, preformed, series gap electrodes and a series gap spacer disposed between said plates, said gap plates being configured to include generally horizontally extending surfaces, a generally vertically extending peripheral wall and means for enabling said electrodes to be moved past said wall into position along said surfaces, said enabling means comprising an opening through said wall, said spacer including both integrally formed means for fixedly positioning said electrodes to form a series gap between said plates and integrally formed means for closing a major portion of said opening.

* * * * *

UNITED STATES PATENT AND TRADEMARK OFFICE

CERTIFICATE OF CORRECTION

PATENT NO. : 4,191,908

DATED : March 4, 1980

INVENTOR(S) : Francis V. Cunningham

It is certified that error appears in the above-identified patent and that said Letters Patent are hereby corrected as shown below:

Claim 13, column 11, line 1, change "clearly" to --closely--; and

Claim 14, column 11, line 11, after "third" insert --air--.

Signed and Sealed this

*Eighth* Day of *July 1980*

[SEAL]

*Attest:*

SIDNEY A. DIAMOND

*Attesting Officer*

*Commissioner of Patents and Trademarks*